US009210752B2

(12) United States Patent
Kobayashi et al.

(10) Patent No.: US 9,210,752 B2
(45) Date of Patent: Dec. 8, 2015

(54) BACKLIGHT DEVICE

(75) Inventors: Takahiro Kobayashi, Osaka (JP); Yoshio Umeda, Hyogo (JP)

(73) Assignee: PANASONIC LIQUID CRYSTAL DISPLAY CO., LTD., Hyogo (JP)

( * ) Notice: Subject to any disclaimer, the term of this patent is extended or adjusted under 35 U.S.C. 154(b) by 323 days.

(21) Appl. No.: 13/353,323

(22) Filed: Jan. 19, 2012

(65) Prior Publication Data

US 2012/0188294 A1 Jul. 26, 2012

(30) Foreign Application Priority Data

Jan. 20, 2011 (JP) ..... 2011-010247

(51) Int. Cl.
*G09G 3/34* (2006.01)
*H05B 33/08* (2006.01)

(52) U.S. Cl.
CPC ..... *H05B 33/0824* (2013.01); *G09G 3/34* (2013.01); *G09G 3/3406* (2013.01); *G09G 3/3426* (2013.01); *G09G 2310/0232* (2013.01); *G09G 2320/0233* (2013.01); *G09G 2320/041* (2013.01); *G09G 2330/00* (2013.01)

(58) Field of Classification Search
CPC ..... G09G 3/3406; G09G 2310/0232; G09G 2320/0233; G09G 2320/041; G09G 2330/00; H05B 33/0824
See application file for complete search history.

(56) References Cited

U.S. PATENT DOCUMENTS

2008/0084240 A1* 4/2008 Passerini et al. ..... 327/539
2008/0088545 A1* 4/2008 Chen et al. ..... 345/76
2008/0245949 A1* 10/2008 Morimoto et al. ..... 250/205
2009/0289965 A1* 11/2009 Kurokawa et al. ..... 345/690
2010/0296026 A1* 11/2010 Kubota et al. ..... 349/62
2012/0081616 A1* 4/2012 Huang ..... 348/739
2012/0320107 A1* 12/2012 Murakami et al. ..... 345/690

FOREIGN PATENT DOCUMENTS

JP 04159519 A * 6/1992
JP 2006-031977 A 2/2006
JP 2010-032731 A 2/2010
JP 2010-49994 A 3/2010
JP 2010-278366 A 12/2010

OTHER PUBLICATIONS

WO 2011/129124 A1.*
Japanese Patent Publication, 2010-091542 by Murakami.*

* cited by examiner

*Primary Examiner* — Joseph Haley
(74) *Attorney, Agent, or Firm* — McDermott Will & Emery LLP

(57) ABSTRACT

A backlight device, used in a liquid crystal display device, comprising: a substrate including first and second areas; a plurality of first light emitting diodes (LEDs) arranged in the first area at a density equal to or higher than a predetermined density; a plurality of second LEDs arranged in the second area at a density lower than the predetermined density; and a control unit configured to control current supplied to the first LEDs with respect to the temperature of the first area, and current supplied to the second LEDs with respect to the temperature of the second area so as to make the rate of change in effective value of the current supplied to the first LEDs different from the rate of change in effective value of the current supplied to the second LEDs when temperatures of the first and second areas are higher than a predetermined temperature.

17 Claims, 11 Drawing Sheets

BACKLIGHT DEVICE

BACKGROUND OF THE INVENTION

1. Technical Field

This disclosure relates to a backlight device.

2. Description of the Related Art

In recent years, LEDs (light-emitting diodes) have been introduced as backlight sources for liquid crystal display devices to save energy. For example, there is known a backlight device that includes a plurality of LEDs arranged on a substrate having a planar shape. FIG. 11 illustrates a plan view and a cross-sectional view along D-D' line of a backlight device 900. The backlight device 900 includes a substrate 901 having a planar shape and a plurality of LEDs 902 arranged on the substrate 901. The LEDs 902 are arranged at a uniform density on the substrate 901. The backlight device 900 is placed parallel and close to a liquid crystal panel 950 indicated by a dashed line in such a manner as to face the back surface of the liquid crystal panel 950, whereby a liquid crystal display device 960 is formed.

The characteristics of LEDs, such as, for example, brightness, chromaticity, and deterioration rate, vary depending on the temperature of the LEDs and the current supplied to the LEDs. Accordingly, in order to extend the lifetime of LEDs while achieving desired brightness or chromaticity, it may be necessary to optimally control, for example, current supplied to the LEDs in accordance with the temperature thereof. When current is supplied to an LED, the LED generates heat. Although the degree of heat generation is lower than that in the case of an incandescent bulb or the like, because of such heat generation, the temperature of an area in which LEDs are densely arranged is more likely to increase than the temperature of an area in which LEDs are sparsely arranged. Therefore, the quality and lifetime of the LEDs in the densely arranged area are more likely to decrease than the LEDs in the sparsely arranged area. To this end, it is important, in terms of image quality, to prevent increase in the temperature of an area in which LEDs are densely arranged. Although the temperature of an area in which LEDs are sparsely arranged is less likely to increase, it is important to note that the brightness in the sparsely arranged LED area is inherently low. To this end, it is important, in terms of image quality, to prevent further decrease in the brightness in an area in which LEDs are sparsely arranged. Therefore, there is a need for a backlight device that can control current applied to LEDs based on the characteristics of the areas in which LEDs are arranged.

BRIEF SUMMARY OF THE INVENTION

In one general aspect, the instant application describes a backlight device used in a liquid crystal display device, and the backlight device that includes a substrate including a first area and a second area; a plurality of first Light Emitting Diodes (LEDs) arranged in the first area at a density equal to or higher than a predetermined density; a plurality of second LEDs arranged in the second area at a density lower than the predetermined density; and a control unit configured to control a current supplied to the first LEDs with respect to the temperature of the first area and a current supplied to the second LEDs with respect to the temperature of the second area so as to make a rate of change in an effective value of the current supplied to the first LEDs different from a rate of change in an effective value of the current supplied to the second LEDs when temperatures of the first and second areas are higher than the predetermined temperature.

The above general aspect may include one or more of the following features. The control unit may be configured to control the current supplied to the first LEDs and the current supplied to the second LEDs so as to make the rate of change in the effective value of the current supplied to the first LEDs greater than the rate of change in the effective value of the current supplied to the second LEDs when the temperatures of the first and second areas are higher than the predetermined temperature. The rate of change in the effective value of the current supplied to the first LEDs may include a rate of decrease of the effective value of the current supplied to the first LEDs with respect to the temperature of the first area as the temperature of the first area becomes higher than the predetermined temperature, and the rate of change in the effective value of the current supplied to the second LEDs may either be substantially zero or may be a rate of decrease of the effective value of the current supplied to the second LEDs with respect to the temperature of the second area as the temperature of the second area becomes higher than the predetermined temperature. The control unit may be configured to maintain the effective value of the current supplied to the first LEDs substantially equal to the effective value of the current supplied to the second LEDs when the temperature of the first and second areas is equal to or lower than the predetermined temperature.

The backlight device may further include a temperature measurement unit configured to measure temperature. The temperatures of the first area and the second area may be calculated based on a temperature measured by the temperature measurement unit. The first area may be located at a central portion of the substrate, and the second area may be located at a peripheral portion of the substrate. The backlight device may further include a reflecting plate having a concave cross-section. The substrate may have a linear shape and may be placed in an area of the reflecting plate including a bottom portion of the reflecting plate. A liquid crystal display device may include the backlight device and a liquid crystal panel.

In another general aspect, the instant application describes another backlight device used in a liquid crystal display device, and the backlight device that includes a substrate including a first area and a second area; a plurality of first LEDs arranged in the first area at a density equal to or higher than a predetermined density; a plurality of second LEDs arranged in the second area at a density lower than the predetermined density; a temperature measurement unit configured to measure temperature of a reference area; and a control unit configured to control a current supplied to the first LEDs and a current supplied to the second LEDs such that, when the temperature of the reference area is higher than a predetermined temperature, an effective value of the current supplied to the first LEDs decreases as the temperature of the reference area increases and an effective value of the current supplied to the second LEDs remains unchanged or decreases, and such that a rate of decrease in the effective value of the current supplied to the first LEDs with respect to the temperature of the reference area is greater than a rate of decrease in the effective value of the current supplied to the second LEDs with respect to the temperature of the reference area.

The above general aspect may include one or more of the following features. The control unit may be configured to control the current supplied to the first LEDs and the current supplied to the second LEDs such that the effective value of the current supplied to the first LEDs and the effective value of the current supplied to the second LEDs are substantially equal to each other when the temperature of the reference area is equal to or lower than the predetermined temperature. The first area may be located at a central portion of the substrate, and the second area may be located at a peripheral portion of the substrate. The reference area may be located in the second area or at a position on a surface of the substrate which is opposite to the surface of substrate on which the first and second LEDs are arranged. The backlight device may further include a reflecting plate having a concave cross-section. The substrate may have a linear shape and may be placed in an area of the reflecting plate including a bottom portion of the reflecting plate. A liquid crystal display device may include the backlight device and a liquid crystal panel.

In another general aspect, the instant application includes a method for controlling currents supplied to a plurality of LEDs in a backlight device in a liquid crystal device. The method includes steps of obtaining temperature measured by temperature measurement unit of the backlight device; calculating, based on the measured temperature, temperature of a first area in which LEDs are arranged at a density equal to or higher than a predetermined density, and a temperature of a second area in which LEDs are arranged at a density lower than the predetermined density; and controlling a current supplied to the LEDs arranged in the first area and LEDs arranged in the second area such that a rate of decrease in a current supplied to the LEDs arranged in the first area with respect to the temperature of the first area is greater than a rate of decrease in a current supplied to the LEDs arranged in the second area with respect to the temperature of the second area when the temperature of the first and second areas are higher than the predetermined temperature.

DETAILED DESCRIPTION

A backlight device of the instant application may be configured to perform current control suitable for an area in which LEDs are densely arranged and current control suitable for an area in which LEDs are sparsely arranged. Thus, the backlight of the instant application can prevent decrease in the quality and lifetime of the LEDs and deterioration in image quality, thereby improving reliability. The backlight device of the instant application may be used in a liquid crystal display device and the like and may be particularly useful for a backlight device including a substrate having an area in which LEDs are densely arranged and an area in which LEDs are sparsely arranged. Other advantages of the instant application will become more apparent from the following detailed description when taken in conjunction with the accompanying drawings.

Figure 1:
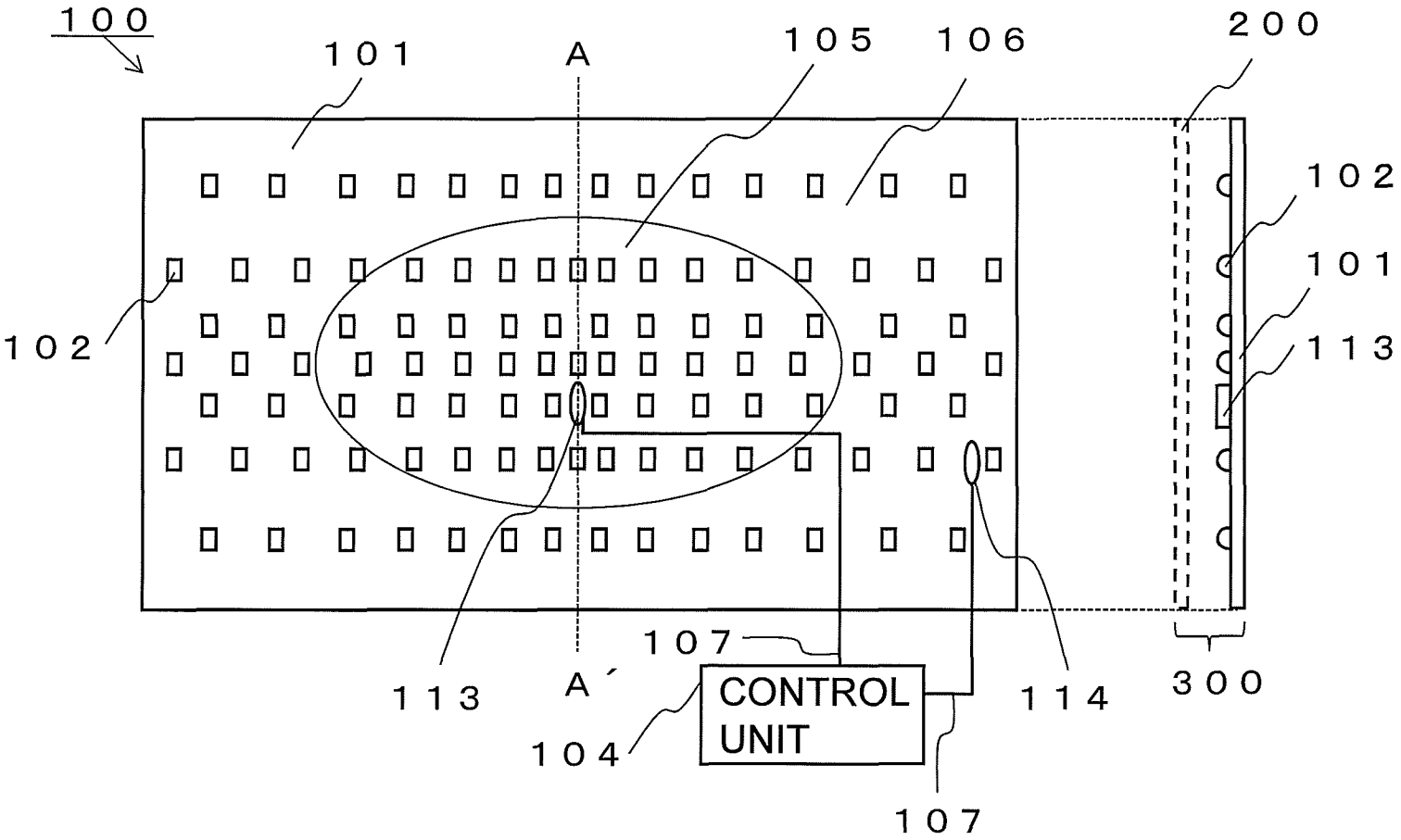
FIG. 1 illustrates a plan view and a cross-sectional view of an exemplary backlight device of the instant application.

FIG. 1 illustrates a plan view and a cross-sectional view along the A-A' line of an exemplary backlight device 100 of the instant application. The backlight device 100 includes a substrate 101 having a planar shape, two temperature measurement units 113 and 114, a control unit 104, and a plurality of LEDs 102 arranged on the substrate 101. In a dense arrangement area 105 which is a central portion of the substrate 101, the LEDs 102 are densely arranged. In a sparse arrangement area 106 which is a peripheral portion of the substrate 101, the LEDs 102 are sparsely arranged. The temperature measurement units 113 and 114 have a function of measuring temperatures and are each connected to the control unit 104 via a signal line 107. In addition, the LEDs 102 are connected to the control unit 104 via power lines which are not shown. The backlight device 100 is placed parallel and close to a liquid crystal panel 200 indicated by a dashed line, whereby a liquid crystal display device 300 is formed. The LED 102 may be a white LED or may be composed of three kinds of LEDs having different colors as long as white light can be obtained from the backlight device 100 as a whole.

Figure 2:
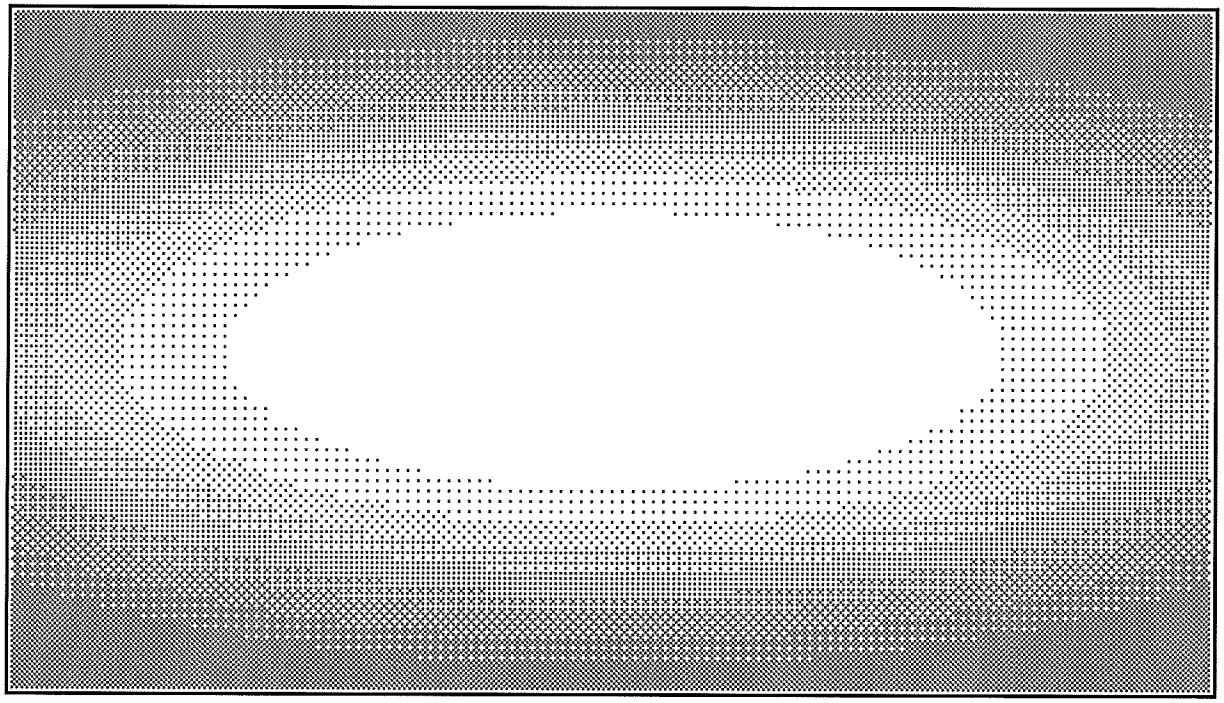
FIG. 2 illustrates brightness distribution of light entering a liquid crystal panel from LEDs of the exemplary backlight device shown in FIG. 1.

FIG. 2 illustrates brightness distribution of light entering the liquid crystal panel 200 from the LEDs 102 of the exemplary backlight device 100 shown in FIG. 1. In FIG. 2, a central portion having higher brightness is shown to be lighter, while a peripheral portion having lower brightness is shown to be darker. This is because the central portion faces the densely arranged LED area 105, and the peripheral portion faces the sparsely arranged LEDs area 106. Generally, when people view a display screen or the like, they focus on the central portion of the screen and do not pay as much attention to the peripheral portion of the screen. Accordingly, the brightness in the central portion of the screen should be relatively high, while the brightness in the peripheral portion of the screen may be relatively low. Relatively low brightness in the peripheral portion requires lesser number of LEDs which are expensive. Therefore, the LEDs on the peripheral portion of the screen can be sparsely arranged (as shown in FIG. 1), resulting in reduction of a manufacturing cost of the backlight device 100.

Referring again to FIG. 1, the temperature measurement unit 113 is placed close to an LED 102 located in the dense arrangement area 105 and measures the temperature of the dense arrangement area 105. The temperature measurement unit 114 is placed close to an LED 102 located in the sparse arrangement area 106 and measures the temperature of the sparse arrangement area 106. The temperature measurement units 113, 114 are connected to the control unit 104 via the signal lines 107.

The control unit 104 may periodically obtain, via the signal lines 107, the temperatures measured by the temperature measurement units 113 and 114. The control unit 104 may utilize the obtained temperatures to calculate the values of currents which should be respectively supplied to the dense arrangement area 105 and the sparse arrangement area 106. The control unit 104 may supply the calculated currents to the LEDs in the dense arrangement area 105 and the LEDs in the sparse arrangement area 106, respectively, via the power lines. In one implementation, the control unit 104 uses the temperatures measured by the temperature measurement units 113 and 114 without modification. In another implementation, the control unit 104 corrects the obtained temperatures by a predetermined method and uses the corrected temperatures.

Hereinafter, exemplary current control methods performed by the control unit 104 of the backlight device 100 will be described. In FIGS. 3-6, the horizontal axis represents temperature, and the vertical axis represents current value. The relationship between the temperature of the dense arrangement area 105 measured by the temperature measurement unit 113 and the value of a current supplied by the control unit 104 to the LEDs 102 in the dense arrangement area 105 is indicated by a solid line. The relationship between the temperature of the sparse arrangement area 106 measured by the temperature measurement unit 114 and the value of a current supplied by the control unit 104 to the LEDs 102 in the sparse arrangement area 106 is indicated by a dashed line.

Figure 3:
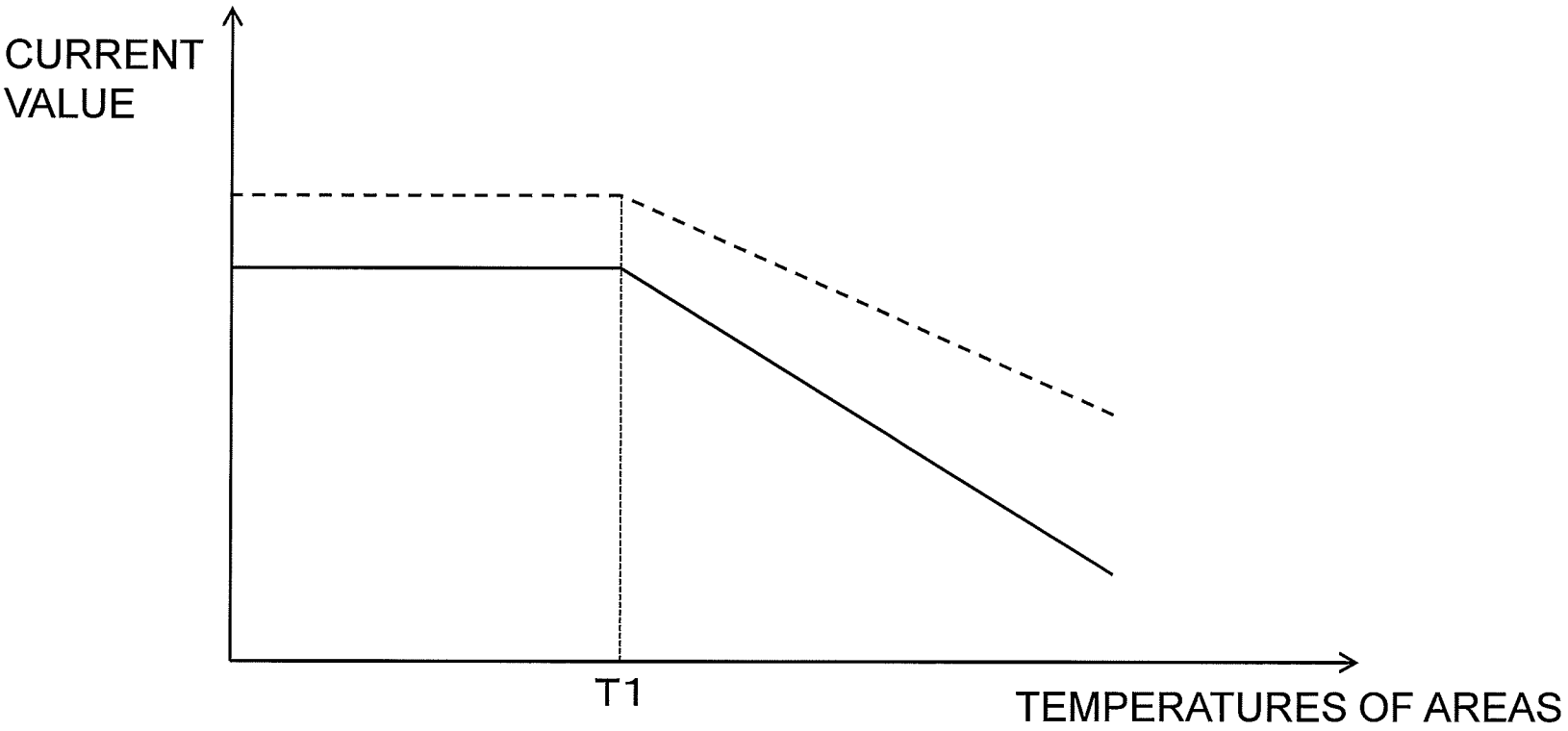
FIGS. 3-6 illustrate exemplary current control methods performed by a control unit of the backlight device shown in FIG. 1.

In the example shown in FIG. 3, when the temperature of the dense arrangement area 105 is not higher than a predetermined temperature T1, the control unit 104 supplies a substantially constant current to the LEDs 102 in the dense arrangement area 105, and when the temperature increases above the predetermined temperature T1, the control unit 104 decreases the supplied current with increase in the temperature. Similarly, when the temperature of the sparse arrangement area 106 is not higher than the predetermined temperature T1, the control unit 104 supplies a substantially constant current to the LEDs 102 in the sparse arrangement area 106, and when the temperature increases above the predetermined temperature T1, the control unit 104 decreases the supplied current with increase in the temperature. As shown, when the temperature increases above the predetermined temperature T1, the rate of change (gradient) of the supplied current to the LEDs 102 in the sparse arrangement area 106 becomes different from the rate of change (gradient) of the supplied current to the LEDs 102 in the dense arrangement area 105. That is, there is a difference between the rate at which the value of the current supplied to the LEDs 102 in the dense arrangement area 105 decreases and the rate at which the value of the current supplied to the LEDs 102 in the sparse arrangement area 106 decreases when the temperatures of the dense arrangement area 105 and sparse arrangement area 106 is higher than the predetermined temperature T1. Specifically, the rate of decrease in the current supplied to the LEDs 102 in the dense arrangement area 105 is greater than the rate of decrease in the current supplied to the LEDs 102 in the sparse arrangement area 106.

The method of current control for the LEDs 102 in the dense arrangement area 105 and the LEDs 102 in the sparse arrangement area 106 may vary depending on the positions of the LEDs 102 on the substrate and the density of the LEDs 102. For example, the method of controlling the current supplied to the LEDs 102 in the dense arrangement area 105 when the temperature of the dense arrangement area 105 is higher than the predetermined temperature is different from the method of controlling the current supplied to the LEDs 102 in the sparse arrangement area 106 when the temperature of the sparse arrangement area 106 is higher than the predetermined temperature. Furthermore, in the example shown in FIG. 3, the value of the current supplied to the LEDs 102 in the dense arrangement area 105 when the temperature of the dense arrangement area 105 is not higher than T1 is different from the value of the current supplied to the LEDs 102 in the sparse arrangement area 106 when the temperature of the sparse arrangement area 106 is not higher than T1.

Figure 4:
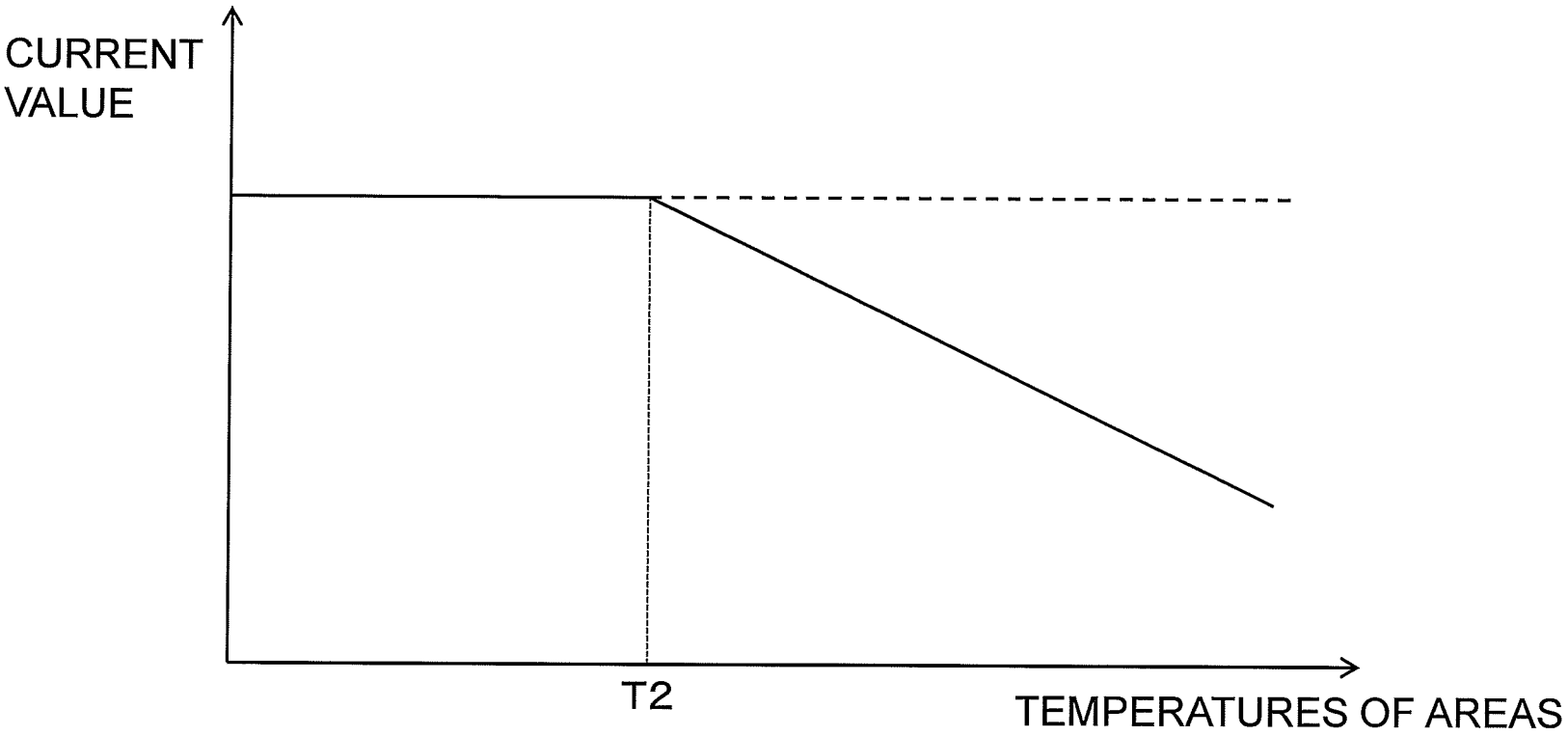

In the example shown in FIG. 4, the value of the current supplied to the LEDs 102 in the dense arrangement area 105 when the temperature of the dense arrangement area 105 is not higher than a predetermined temperature T2 is substantially constant and equal to the value of current supplied to the LEDs 102 in the sparse arrangement area 106 when the temperature of the sparse arrangement area 106 is not higher than the predetermined temperature T2. Since substantially equal currents are being supplied regardless of the positions of the LEDs 102, current control may become easier when the temperature of the dense arrangement area 105 and the sparse arrangement area 106 are below the predetermined temperature T2. When the temperature of the dense arrangement area 105 increases above the predetermined temperature T2, the control unit 104 decreases the value of the current supplied to the LEDs 102 in the dense arrangement area 105 with increase in the temperature. On the other hand, when the temperature of the sparse arrangement area 106 increases above the predetermined temperature T2, the control unit 104 keeps substantially constant the value of the current supplied to the LEDs 102 in the sparse arrangement area 106. To this end, the control unit 104 performs control so as to make a difference between the rate of change in the value of the current supplied to the LEDs 102 in the dense arrangement area 105 when the temperature of the dense arrangement area 105 increases above the predetermined temperature T2, and the rate of change in the value of the current supplied to the LEDs 102 in the sparse arrangement area 106 when the temperature of the sparse arrangement area 106 increases above the predetermined temperature T2. Since the density of the LEDs 102 in the sparse arrangement area 106 is low, there may be a case where it is not necessary to assume that the temperature of the sparse arrangement area 106 becomes high. In light of this, the value of the current supplied to the LEDs 102 in the sparse arrangement area 106 is set to be substantially constant regardless of the temperature of the sparse arrangement area 106 to make the control easy.

Figure 5:
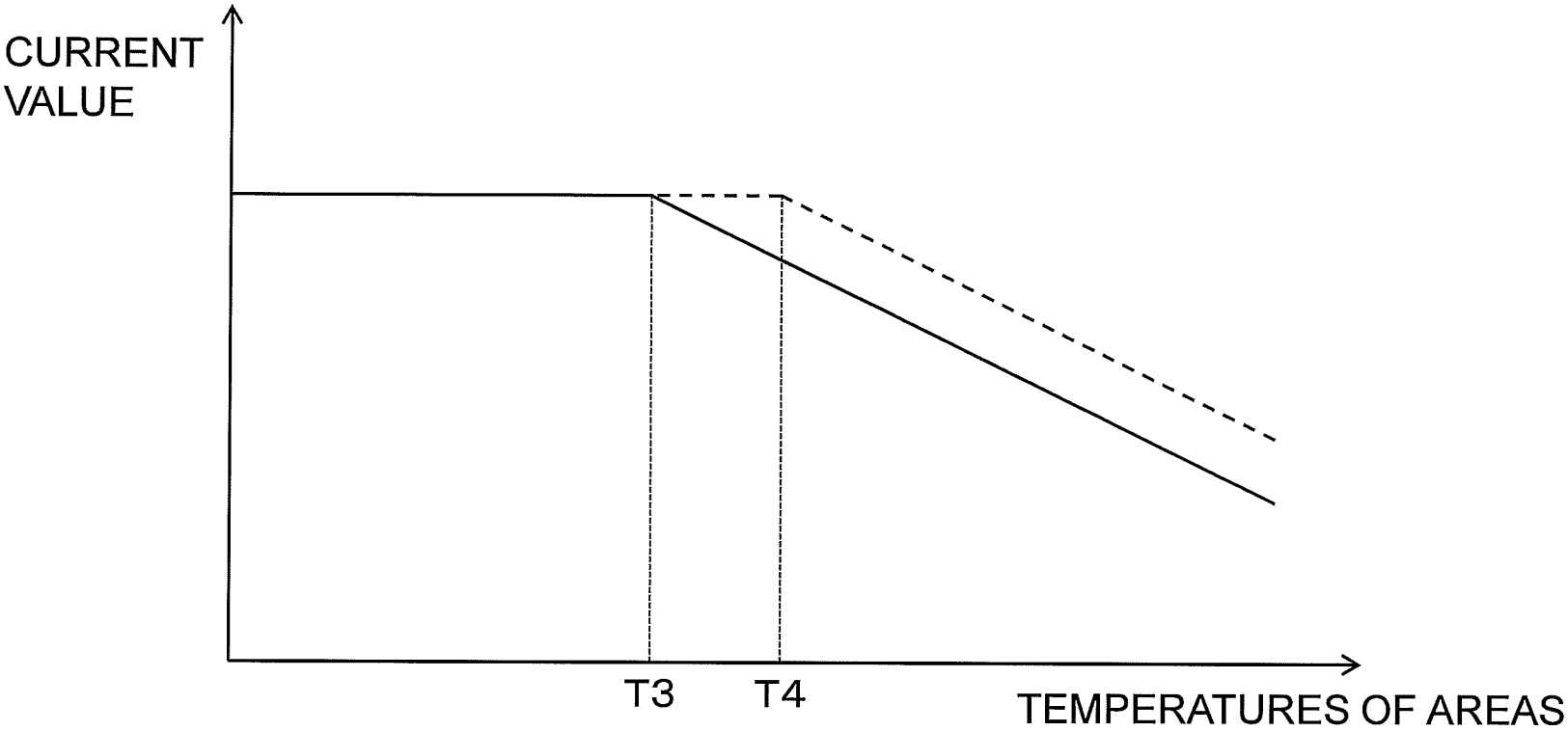

In the example shown in FIG. 5, when the temperature of the dense arrangement area 105 is not higher than a predetermined temperature T3, the control unit 104 supplies a substantially constant current to the LEDs 102 in the dense arrangement area 105, and when the temperature increases above the predetermined temperature T3, the control unit 104 decreases the supplied current with increase in the temperature. When the temperature of the sparse arrangement area 106 is not higher than a predetermined temperature T4 (T4>T3), the control unit 104 supplies a substantially constant current to the LEDs 102 in the sparse arrangement area 106, and when the temperature increases above the predetermined temperature T4, the control unit 104 decreases the supplied current with increase in the temperature. In the example shown in FIG. 5, the value of the current supplied to the LEDs 102 in the dense arrangement area 105 when the temperature of the dense arrangement area 105 is not higher than T3 is substantially equal to the value of the current supplied to the LEDs 102 in the sparse arrangement area 106 when the temperature of the sparse arrangement area 106 is not higher than T3. When the temperature of the sparse arrangement area 106 increases above the predetermined temperature T3 but remains below the predetermined temperature T4, the rate of change (the rate of decrease of the current value with increase in the temperature) of the current supplied to the LEDs 102 in the sparse arrangement area 106 remains substantially zero. On the other hand, when the temperature of the dense arrangement area 105 increases above the predetermined temperature T3, the rate of change (the rate of decrease of the current value with increase in the temperature) of the current supplied to the LEDs 102 in the dense arrangement area 105 is not zero. The control unit 104 controls the values of current supplied to LEDs 102 in the dense arrangement area 105 and the sparse arrangement area 106 so as to make a difference between the rates of change (the rates of decrease) in the currents which are respectively supplied to the LEDs 102 in the dense arrangement area 105 and the LEDs 102 in the sparse arrangement area 106.

Figure 6:
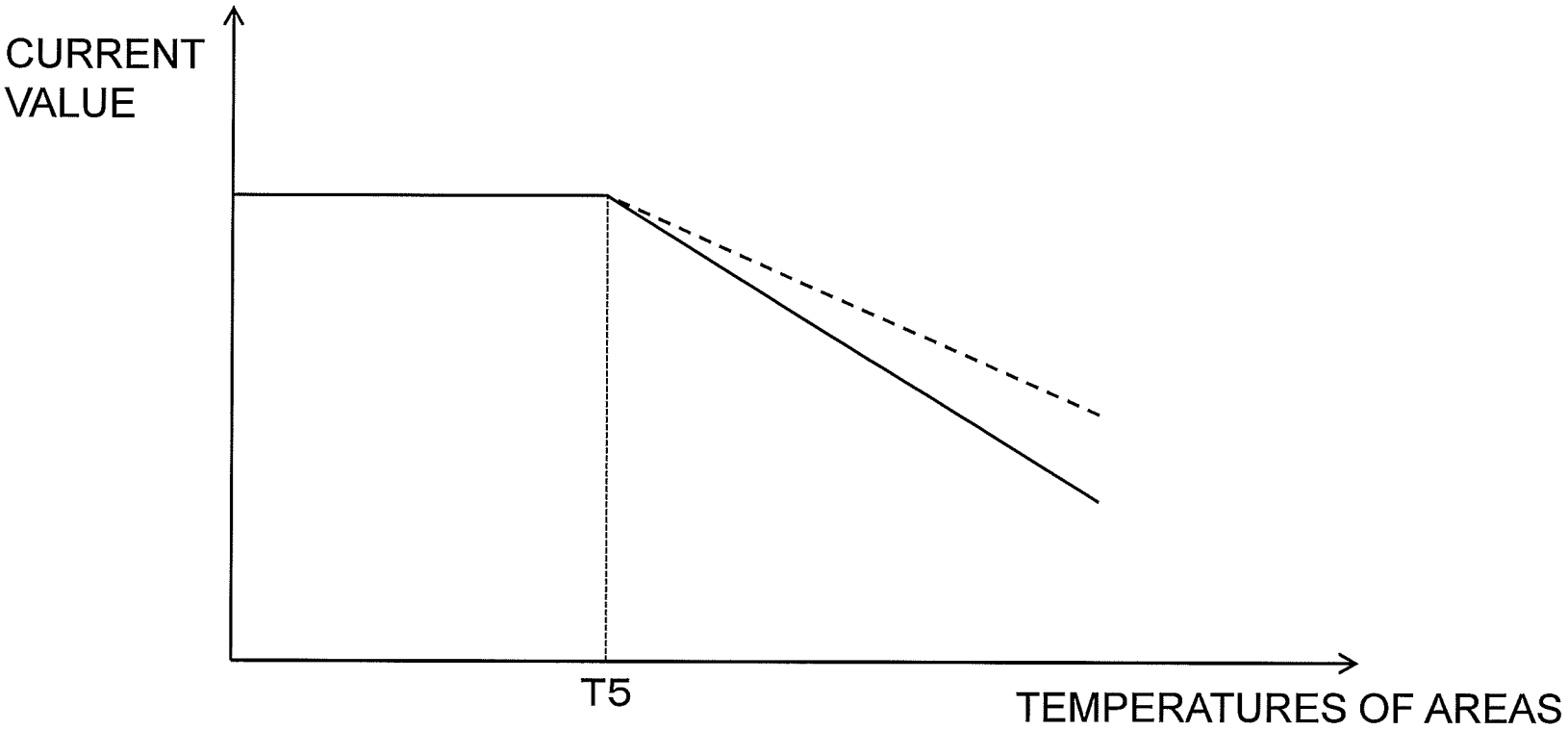

In the example shown in FIG. 6, the value of current supplied to the LEDs 102 in the dense arrangement area 105 when the temperature of the dense arrangement area 105 is not higher than a predetermined temperature T5 is substantially constant and equal to the value of the current supplied to the LEDs 102 in the sparse arrangement area 106 when the temperature of the sparse arrangement area 106 is not higher than the predetermined temperature T5. When the temperature of the dense arrangement area 105 increases above the predetermined temperature T5, the control unit 104 decreases the value of the current supplied to the LEDs 102 in the dense arrangement area 105 with increase in the temperature. Similarly, when the temperature of the sparse arrangement area 106 increases above the predetermined temperature T5, the control unit 104 decreases the value of the current supplied to the LEDs 102 in the sparse arrangement area 106 with increase in the temperature. The rate of decrease in the current supplied to the LEDs 102 in the dense arrangement area 105 is greater than the rate of decrease in the current supplied to the LEDs 102 in the sparse arrangement area 106.

In above-described examples, when the temperatures of the LEDs 102 in the dense arrangement area 105 become high, the backlight device 100 decreases the supplied current to the LEDs 102 in the dense arrangement area 105 to reduce the amount of generated heat and to thereby decrease the temperatures. Therefore, the backlight device 100 can prevent the decrease in the quality and lifetime of the LEDs 102. Furthermore, since the value of the current supplied to the LEDs 102 in the sparse arrangement area 106 is gently decreased or is kept constant, decrease in brightness in the sparse arrangement area 106 may be reduced. This can prevent deterioration in image quality at the peripheral portion of the liquid crystal panel 200, thereby improving reliability of the backlight device 100. To illustrate further, when the dense arrangement area 105 is placed at the central portion of the substrate 101, the temperature of the dense arrangement area 105 becomes less likely to decrease due to such a structure. Therefore, the control unit 104 may be required to promptly decrease the supplied current to the LEDs 102 in the dense arrangement area 105 for reducing the amount of generated heat. However, when the sparse arrangement area 106 is placed at the peripheral portion of the substrate 101, the temperature of the sparse arrangement area 106 becomes more likely to decrease due to such a structure. Therefore, the control unit 104 may not be required to promptly decrease the supplied current to the LEDs 102 in the sparse arrangement area 106 for reducing the amount of generated heat.

The relationship between the temperature of the dense arrangement area 105 and the supplied current to the LEDs 102 of the dense arrangement area 105 is not limited to such relationships as described above. Other types of appropriate current control may be performed, depending on the difference between the characteristics of the dense arrangement area 105 and the characteristics of the sparse arrangement area 106. The characteristics may be associated with the temperatures of the areas 105, 106 and may be relevant to the maintenance of quality.

Although the control unit 104 controls the values of supplied currents in the above examples, the control unit 104 may also be capable of controlling effective values represented by, for example, temporal average values of currents. For example, the control unit 104 may supply pulse currents and control the duty ratios of the pulse currents. Alternatively, the control unit 104 may control both the current values and the duty ratios of the pulse currents. In the case where the control unit 104 supplies pulse currents, the control unit 104 may control the current values or the duty ratios of the pulse currents such that the effective values of the currents are represented by, for example, the graphs shown in FIG. 3 or FIG. 4.

Figure 7:
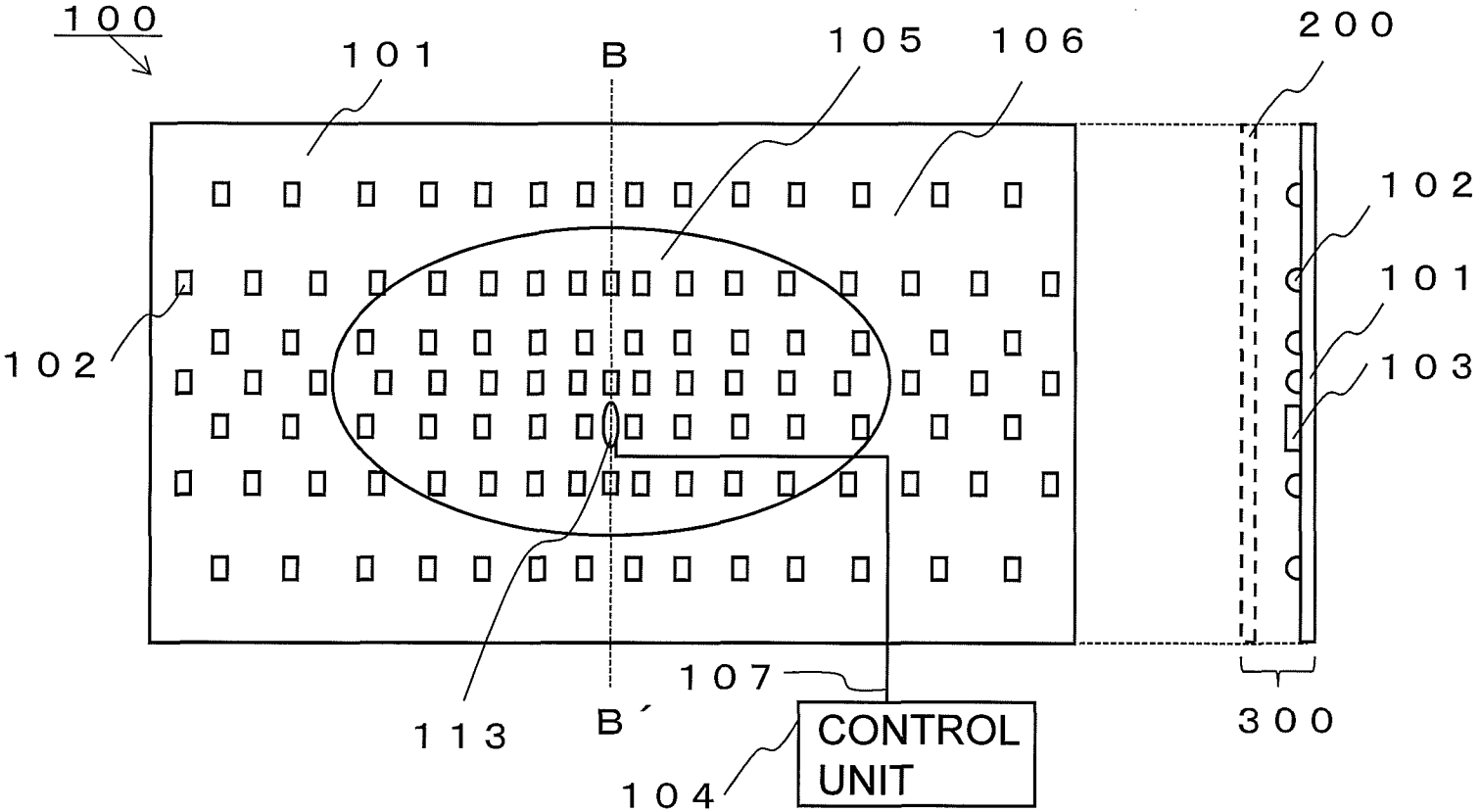
FIG. 7 illustrates a plan view and a cross-sectional view of another exemplary backlight device of the instant application.

FIG. 7 illustrates a plan view and a cross-sectional view along the B-B' line of another exemplary backlight device 400 of the instant application. The backlight device 400 is based on the backlight device 100 and includes the temperature measurement unit 113 but does not include the temperature measurement unit 114. The other components of the backlight device 400 are the same as those of the backlight device 100 and thus are denoted by the same reference characters.

In the example shown in FIG. 7, the temperature measurement unit 113 is placed close to one LED 102 located in the dense arrangement area 105 and measures the temperature of the dense arrangement area 105. However, it may be difficult at times to place the temperature measurement unit 113 in the dense arrangement area 105 on the substrate 101. In such a case, the temperature measurement unit 113 may be placed in the sparse arrangement area 106 on the substrate 101 or may be placed at a position on a surface of the substrate 101, which is opposite to the surface on which the LEDs 102 are arranged. Alternatively, the temperature measurement unit 113 may be placed on the liquid crystal panel 200 or may be attached to a component of a product such as, for example, a liquid crystal display television into which the liquid crystal display device 300 is incorporated.

The control unit 104 may periodically obtain a temperature measured by the temperature measurement unit 113 as a reference temperature. Depending on the position at which the temperature measurement unit 113 is placed, the reference temperature can differ from the temperature of the dense arrangement area 105 or the sparse arrangement area 106. However, the reference temperature has certain correlations with the temperatures of these areas. Accordingly, the temperatures of the dense arrangement area 105 and the sparse arrangement area 106 can be estimated from the reference temperature with a certain accuracy.

Figure 8:
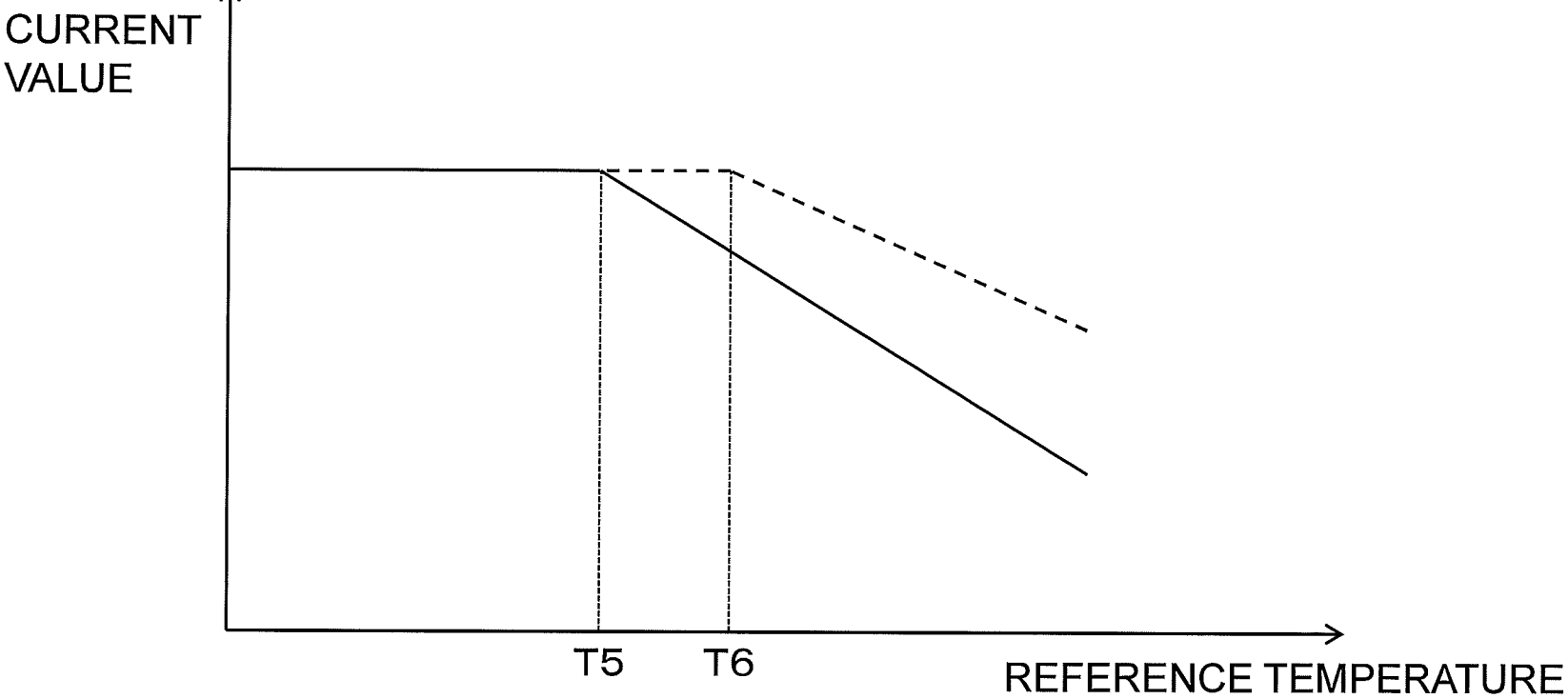
FIG. 8 illustrates an exemplary current control method performed by a control unit of the backlight device shown in FIG. 7.

Hereinafter, an exemplary current control method performed by the control unit 104 of the backlight device 400 will be described. The control unit 104 controls the values of the supplied current based on the same reference temperature. In this respect, the backlight device 400 is different from the backlight device 100 in which the values of the supplied current are controlled based on the temperatures of the dense arrangement area 105 and the sparse arrangement area 106. In FIG. 8, the horizontal axis represents temperature, and the vertical axis represents current value. The relationship between the reference temperature measured by the temperature measurement unit 113 and the value of a current supplied by the control unit 104 to the LEDs 102 in the dense arrangement area 105 is indicated by a solid line. The relationship between the reference temperature measured by the temperature measurement unit 113 and the value of a current supplied by the control unit 104 to the LEDs 102 in the sparse arrangement area 106 is indicated by a dashed line.

As shown, when the reference temperature is not higher than a predetermined temperature T5, the control unit 104 supplies a substantially constant current to the LEDs 102 in the dense arrangement area 105, and when the reference temperature increases above the predetermined temperature T5, the control unit 104 decreases the supplied current with increase in the reference temperature. Similarly, when the reference temperature is not higher than a predetermined temperature T6 (T6>T5), the control unit 104 supplies a substantially constant current to the LEDs 102 in the sparse arrangement area 106, and when the reference temperature increases above the predetermined temperature T6, the control unit 104 decreases the supplied current with increase in the reference temperature. Since the temperature measurement unit 113 is placed in the dense arrangement area 105, the reference temperature corresponds to the temperature of the dense arrangement area 105. On the other hand, the temperature of the sparse arrangement area 106 is certain degrees lower than the temperature of the dense arrangement area 105. Based on the temperature difference, the temperature at which the control unit 104 starts to decrease the value of the supplied current to the LEDs 102 in the sparse arrangement area 106 from a substantially constant value, is set to T6 instead of T5. In addition, when the reference temperatures of the dense arrangement area 105 and the sparse arrangement area 106 are not higher than T5, the supplied current to the LEDs 102 in the dense arrangement area 105 is substantially equal to the supplied current to the LEDs 102 in the sparse arrangement area 106. Therefore, the solid line representing the current supplied to the LEDs 102 in the dense arrangement area 105 overlaps with the dashed line representing the current supplied to the LEDs 102 in the spare arrangement area 106. Furthermore, the control unit 104 performs control such that, when the reference temperature increases above the predetermined temperature T6, the rate of decrease in the value of the current supplied to the LEDs 102 in the dense arrangement area 105 is greater than the rate of decrease in the value of the current supplied to the LEDs 102 in the sparse arrangement area 106.

Thus, according to the backlight device 400, when the temperature of the dense arrangement area 105 becomes high, the supplied current to the LEDs 102 in the dense arrangement area 105 is promptly decreased to reduce the amount of generated heat and to thereby decrease temperature. To this end, the instant application can prevent decrease in the quality and lifetime of the LEDs 102. In addition, since the supplied current to the LEDs 102 in the sparse arrangement area 106 is gently decreased, decrease in brightness can be reduced. This can prevent deterioration in image quality at the peripheral portion of the liquid crystal panel 200, leading to an improved reliability of backlight device 400.

The relationships between the temperature obtained by the control unit 104 and the supplied current controlled by the control unit 104 are not limited to those described in the above example. Other types of appropriate current control may be performed by the control unit 104, depending on the difference between the characteristics of the dense arrangement area 105 and the characteristics of the sparse arrangement area 106. The characteristics may be associated with the temperatures of the areas 105, 106 and may be relevant to the maintenance of quality. Furthermore, similar to control unit 104 of back light device 100, the control unit 104 of backlight device 400 may supply pulse current and control the duty ratios of the pulse current.

Figure 9:
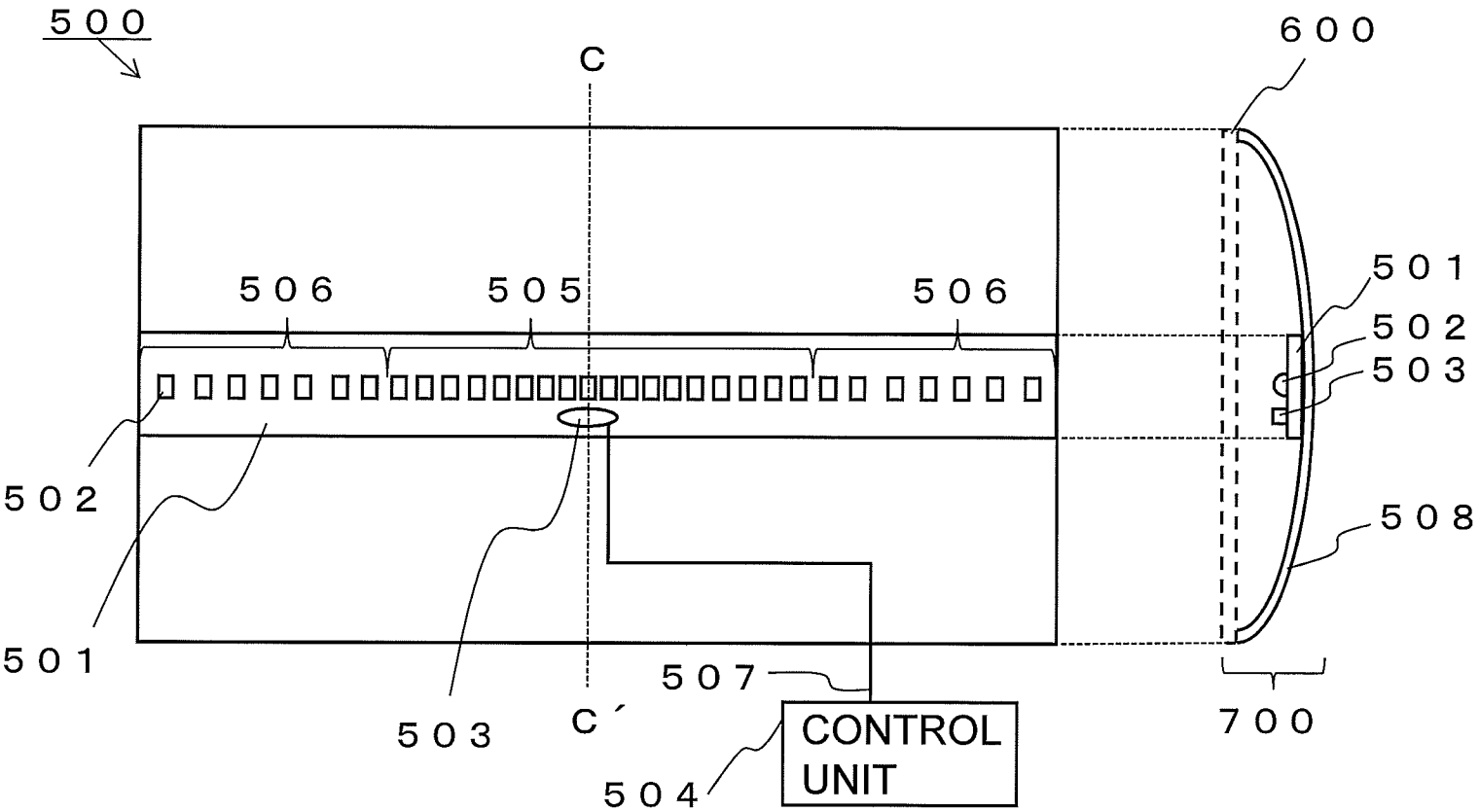
FIG. 9 illustrates a plan view and a cross-sectional of another exemplary backlight device of the instant application.

FIG. 9 illustrates a plan view and a cross-sectional view along the C-C' line of another exemplary backlight device 500 of the instant application. The backlight device 500 includes a reflecting plate 508 having a cross-section which is concavely curved, a substrate 501 having a linear shape and placed at a central portion of the reflecting plate 508, that is, the bottom portion of the concave cross-section, a temperature measurement unit 503, a control unit 504, and a plurality of LEDs 502 arranged on the substrate 501. In a dense arrangement area 505, which is a central portion of the substrate 501, the LEDs 502 are densely arranged. In a sparse arrangement area 506, which is a peripheral portion of the substrate 501, the LEDs 502 are sparsely arranged. The temperature measurement unit 503 has a function of measuring temperatures and is connected to the control unit 104 via a signal line 507. The LEDs 102 are connected to the control unit 104 via power lines which are not shown. The backlight device 500 is attached to a liquid crystal panel 600 indicated by a dashed line in such a manner that the end edges of the reflecting plate 508 are coupled to the end edges of the liquid crystal panel 600, whereby a liquid crystal display device 700 is formed.

Figure 10:
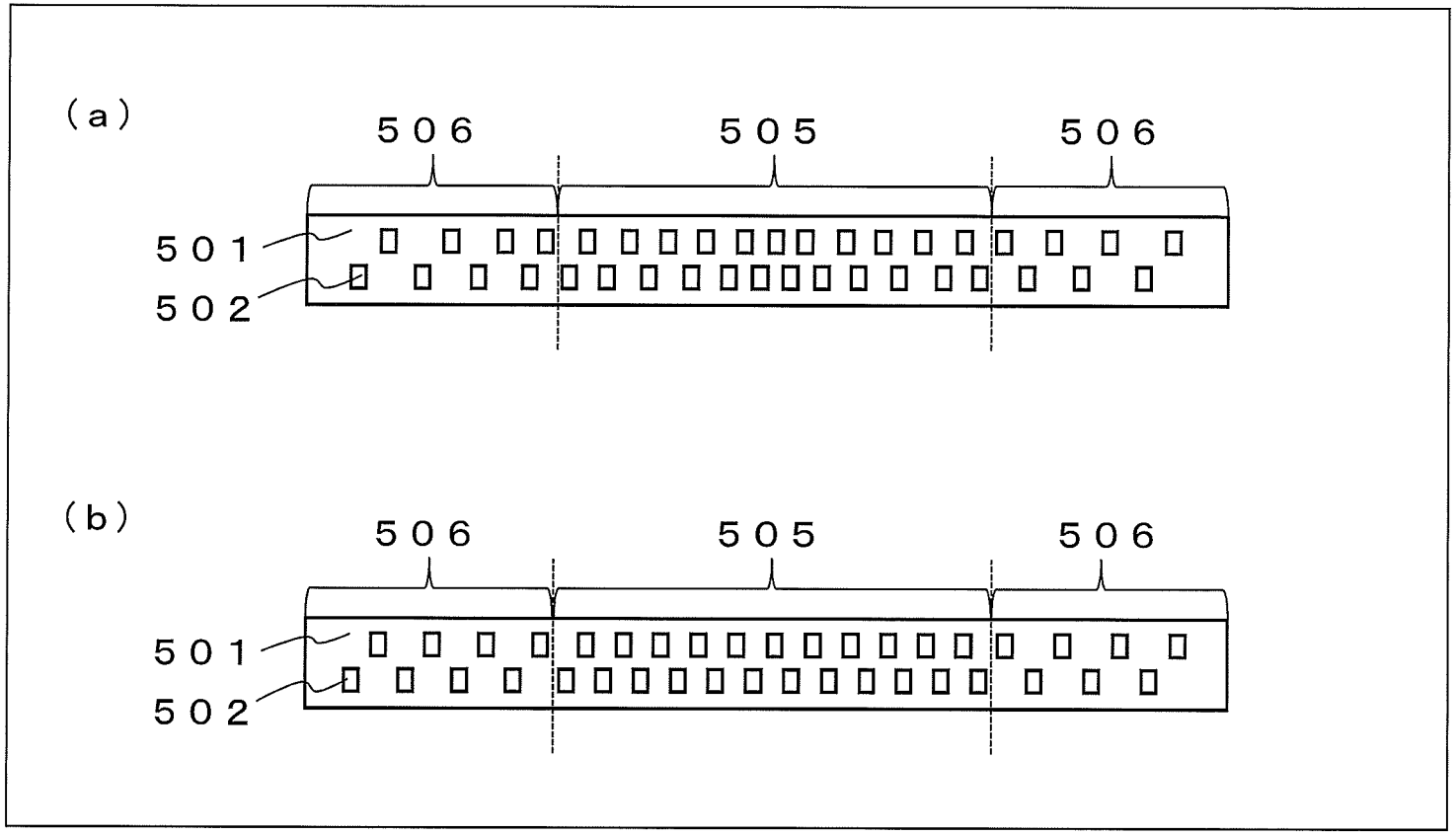
FIG. 10 illustrates the arrangement density of LEDs in a dense arrangement area and a sparse arrangement area of the backlight device shown in FIG. 9 is uniform (a) and the arrangement density of LEDs in a dense arrangement area and a sparse arrangement area of the backlight device shown in FIG. 9 continuously changes (b)
Figure 11:
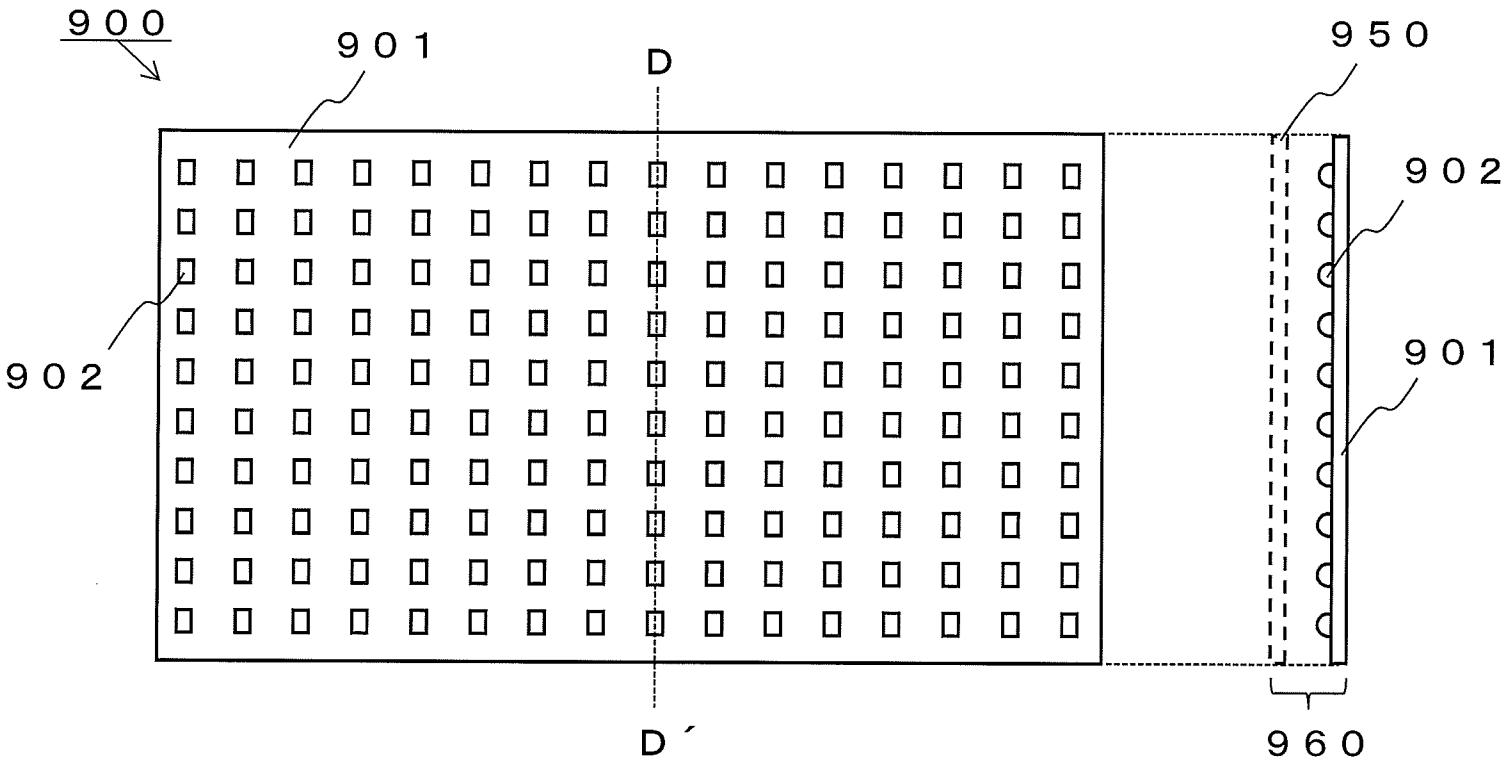
FIG. 11 PRIOR ART
FIG. 11 illustrates a configuration of a backlight device.

Similar to the LED 102 of the backlight device 100, the LED 502 of the backlight device 500 may be a white LED or may be composed of three kinds of LEDs having different colors. A part of light emitted from the LEDs 502 may directly enter the liquid crystal panel 600 and the rest of the light may be reflected by the reflecting plate 508 and then enter the liquid crystal panel 600. Therefore, even though the number of the LEDs 502 is smaller than the number of the LEDs 102, the brightness distribution of the light entering the liquid crystal panel 600 can be made the same as that shown in FIG. 2. Although FIG. 9 illustrates an example in which the LEDs 502 are arranged on the substrate 501 in a single line, the LEDs 502 may be arranged in two or more lines as shown in FIG. 10(*a*-b). Furthermore, as shown in FIG. 10(*a*), the arrangement density of the LEDs 502 in the dense arrangement area 505 and the sparse arrangement area 506 may be uniform. Alternatively, as shown in FIG. 10(*b*), the arrangement density of the LEDs 502 in the dense arrangement area 505 and the sparse arrangement area 506 may continuously change.

Referring again to FIG. 9, the temperature measurement unit 503 is placed close to one LED 502 located in the dense arrangement area 505. However, if such placement is difficult, the temperature measurement unit 503 may be placed at another portion as described above with respect to backlight device 400 shown in FIG. 7.

Similar to the control unit 104 of the backlight device 400, the control unit 504 obtains a temperature measured by the temperature measurement unit 503 as a reference temperature via the signal line 507 and controls, based on the obtained reference temperature, the values of the current which are respectively supplied to the dense arrangement area 505 and the sparse arrangement area 506. The method of controlling the current values of may be the same as the method of controlling the current values described with respect to the backlight device 400.

If the current values are controlled in the backlight device 500, for example, in the same manner as that in the example shown in FIG. 8, when the temperature of the dense arrangement area 505 becomes high, the supplied current to the LEDs 502 in the dense arrangement area 505 is promptly decreased to reduce the amount of generated heat and to thereby decrease the temperature. To this end, the instant application can prevent a decrease in the quality and lifetime of the LEDs 502. In addition, since the supplied current to the LEDs 502 in the sparse arrangement area 506 is gently decreased, decrease in brightness can be reduced. This can prevent deterioration in image quality at the peripheral portion of the liquid crystal panel 600, leading to an improved reliability of the backlight device 500. The relationships between the temperature obtained by the control unit 504 and the supplied current controlled by the control unit 504 are not limited to those described in the above example. Other types of appropriate current control may be performed, depending on the difference between the characteristics of the dense arrangement area 505 and the characteristics of the sparse arrangement area 506. The characteristics may be associated with the temperatures of the areas 505, 506, may be relevant to the maintenance of quality, and may depend on the correlations of the reference temperature with the temperatures of the LEDs 502 in the dense arrangement area 505 and the temperatures of the LEDs 502 in the sparse arrangement area 506. Furthermore, similar to the control unit 104 of the backlight device 100, the control unit 504 of the backlight device 500 may supply current and control the duty ratios of the pulse current.

Furthermore, similar to the backlight device 100, the backlight device 500 may include two temperature measurement units, and the control unit 504 may obtain the temperature of the dense arrangement area 505 and the temperature of the sparse arrangement area 506 from the two temperature measurement units and may control the values of the supplied current based on the obtained temperatures.

The number of the LEDs 502 can be made smaller than the numbers of the LEDs 102 shown in the backlight device 100 and the backlight device 400. As a result, the cost associated with the backlight device 500 and the probability of breakdown of LEDs 502 may be reduced, thereby increasing the reliability of the backlight device 500.

Other implementations are contemplated. For example, in the above-described implementations, an area in which LEDs are arranged is divided into two areas, namely, a dense arrangement area and a sparse arrangement area. However, the area in which LEDs are arranged may be divided into three or more areas depending on the arrangement density of the LEDs and the positions of the LEDs on a substrate, and currents which are respectively supplied to the three or more areas may be individually controlled. Furthermore, three or more temperature measurement units may be provided to enhance the accuracy of measuring the temperature of each of the areas.

What is claimed is:

1. A backlight device used in a liquid crystal display device, the backlight device comprising:

a substrate including a first area and a second area that is different from the first area;

a plurality of first Light Emitting Diodes (LEDs) arranged in the first area at a density equal to or higher than a predetermined density;

a plurality of second LEDs arranged in the second area at a density lower than the predetermined density; and a control unit configured to (i) control current supplied to the first LEDs in accordance with a first decrease rate, being a rate of decrease in effective value of current supplied to the first LEDs with respect to increase in temperature of the first area, when the temperature of the first area is detected to be higher than a predetermined first temperature, and (ii) control current supplied to the second LEDs in accordance with a second decrease rate, being a rate of decrease in effective value of current supplied to the second LEDs with respect to increase in temperature of the second area, when the temperature of the second area is detected to be higher than a predetermined second temperature, the second decrease rate being lower than the first decrease rate.

2. The backlight device according to claim 1, wherein the second decrease rate is substantially zero or a value higher than zero.

3. The backlight device according to claim 1, wherein the control unit is configured to control the effective value of the current supplied to the first LEDs to a value substantially equal to the effective value of the current supplied to the second LEDs at a time when the temperature of the second area is equal to or lower than the second temperature, when the temperature of the first area is detected to be equal to or lower than the first temperature.

4. The backlight device according to claim 1, further comprising a temperature measurement unit configured to measure temperature, wherein the temperature of the first area and the temperature of the second area are calculated respectively based on temperature measured by the temperature measurement unit.

5. The backlight device according to claim 1, wherein the first area is located at a central portion of the substrate, and the second area is located at a peripheral portion of the substrate.

6. The backlight device according to claim 1, further comprising a reflecting plate having a concave cross-section, wherein the substrate has a linear shape and is placed in an area of the reflecting plate including a bottom portion of the reflecting plate.

7. A liquid crystal display device comprising the backlight device according to claim 1 and a liquid crystal panel.

8. A backlight device used in a liquid crystal display device, the backlight device comprising:

a substrate including a first area and a second area that is different from the first area;

a plurality of first LEDs arranged in the first area at a density equal to or higher than a predetermined density;

a plurality of second LEDs arranged in the second area at a density lower than the predetermined density;

a temperature measurement unit configured to measure temperature of a reference area; and a control unit configured to, when the temperature of the reference area is detected to be higher than a predetermined temperature, (i) control current supplied to the first LEDs in accordance with a first decrease rate, being a rate of decrease in current supplied to the first LEDs with respect to increase in temperature of the first area, such that an effective value of the current supplied to the first LEDs decreases as the temperature of the reference area increases, and (ii) control current supplied to the second LEDs in accordance with a second decrease rate, being a rate of decrease in current supplied to the second LEDs with respect to increase in temperature of the second area, such that an effective value of the current supplied to the second LEDs remains unchanged or decreases with increase in temperature of the reference area, the second decrease rate being lower than the first decrease rate.

9. The backlight device according to claim 8, wherein the control unit is configured to control the current supplied to the first LEDs and the current supplied to the second LEDs such that the effective value of the current supplied to the first LEDs and the effective value of the current supplied to the second LEDs are substantially equal to each other, when the temperature of the reference area is detected to be equal to or lower than the predetermined temperature.

10. The backlight device according to claim 8, wherein the first area is located at a central portion of the substrate, and the second area is located at a peripheral portion of the substrate.

11. The backlight device according to claim 8, wherein the reference area is located in the second area or at a position on a surface of the substrate which is opposite to the surface of substrate on which the first and second LEDs are arranged.

12. The backlight device according to claim 8, further comprising a reflecting plate having a concave cross-section, wherein the substrate has a linear shape and is placed in an area of the reflecting plate including a bottom portion of the reflecting plate.

13. A liquid crystal display device comprising the backlight device according to claim 8 and a liquid crystal panel.

14. A method for controlling currents supplied to a plurality of LEDs in a backlight device used in a liquid display device, the method comprising steps of:

obtaining temperature measured by a temperature measurement unit of the backlight device;

calculating, based on the measured temperature, temperature of a first area in which first LEDs are arranged at a density equal to or higher than a predetermined density, and temperature of a second area that is different from the first area and in which second LEDs are arranged at a density lower than the predetermined density;

controlling current supplied to the first LEDs in accordance with a first decrease rate, being a rate of decrease in effective value of current supplied to the first LEDs with respect to increase in temperature of the first area, when the temperature of the first area is detected to be higher than a predetermined first temperature; and controlling current supplied to the second LEDs in accordance with a second decrease rate, being a rate of decrease in effective value of current supplied to the second LEDs with respect to increase in temperature of the second area, when the temperature of the second area is detected to be higher than a predetermined second temperature, the second decrease rate being lower than the first decrease rate.

15. The backlight device according to claim 1, wherein the second area does not overlap with the first area.

16. The backlight device according to claim 1, further comprising a temperature measurement unit configured to measure the temperature of the first area and the temperature of the second area, wherein the control unit is configured to correct the measured temperatures of the first and second areas and use the corrected temperatures of the first and second areas to control currents supplied to the first and second LEDs.

17. The backlight device according to claim 1, wherein the predetermined second temperature is higher than the predetermined first temperature.

* * * * *